US006164104A

United States Patent [19]

Noé et al.

[11] Patent Number: 6,164,104

[45] Date of Patent: Dec. 26, 2000

[54] METHOD OF AND APPARATUS FOR MEASURING PLANARITY OF METAL STRIP

[75] Inventors: Rolf Noé , Mülheim/Ruhr; Andreas Noé , Kerken, both of Germany

[73] Assignee: BWG Bergwerk- und Walzwerk-Maschinenbau GmbH, Duisberg, Germany

[21] Appl. No.: 09/404,492

[22] Filed: Sep. 23, 1999

[30] Foreign Application Priority Data

Sep. 24, 1998 [DE] Germany ..... 198 43 899

[51] Int. Cl.[7] ..... B21B 37/48

[52] U.S. Cl. ..... 72/12.3; 72/9.1; 72/11.7

[58] Field of Search ..... 72/8.3, 8.6, 8.7, 72/9.1, 11.2, 11.4, 11.7, 12.3, 205, 365.2; 226/143, 195

[56] References Cited

U.S. PATENT DOCUMENTS

| | | | |
|---|---|---|---|
| 4,753,093 | 6/1988 | Siemon et al. | 72/11.7 |
| 4,860,212 | 8/1989 | Uesugi | 72/11.7 |
| 5,546,779 | 8/1996 | Ginzburg | 72/11.7 |
| 5,778,717 | 7/1998 | Berger et al. | 72/205 |
| 5,964,114 | 10/1999 | Noe et al. | 72/9.1 |

FOREIGN PATENT DOCUMENTS

| | | |
|---|---|---|
| 28 13 719 | 10/1978 | Germany . |
| 42 24 569 | 7/1992 | Germany . |

*Primary Examiner*—Ed Tolan
*Attorney, Agent, or Firm*—Herbert Dubno

[57] ABSTRACT

The planarity of a strip, especially metal strip is measured in a measurement zone in which the tension of the strip has been reduced in a targeted way by braking the strip. The braking force should be practically equal to the strip tension.

14 Claims, 2 Drawing Sheets

FIG.1
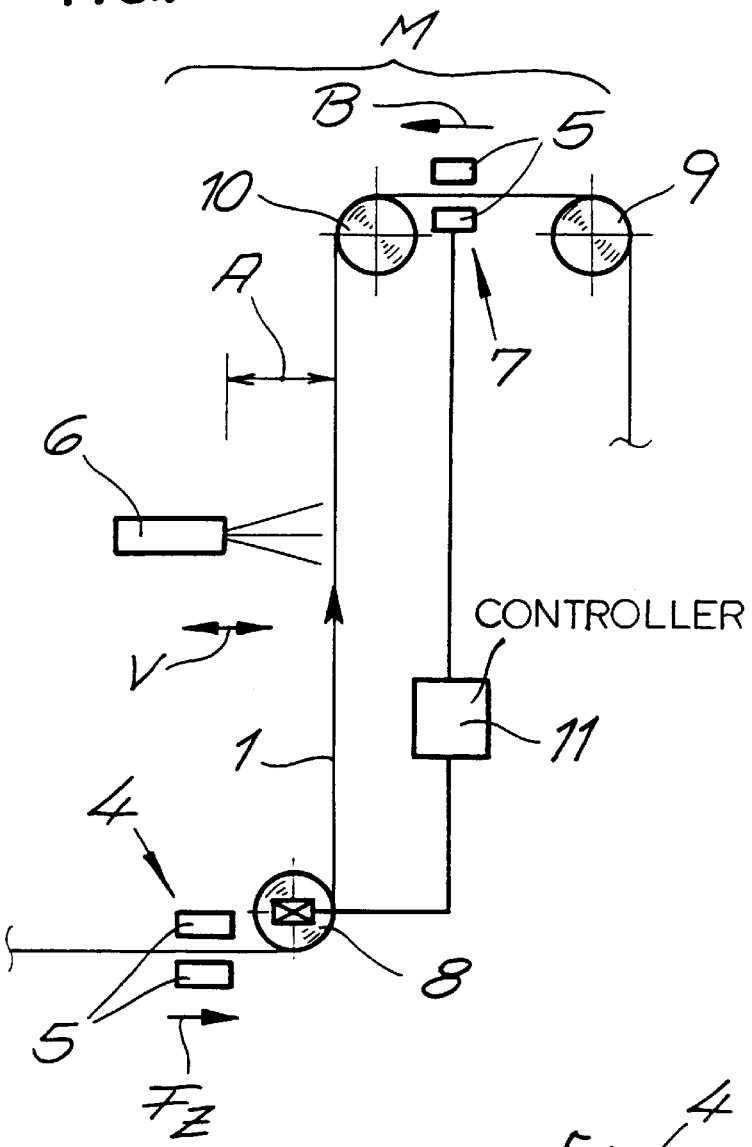
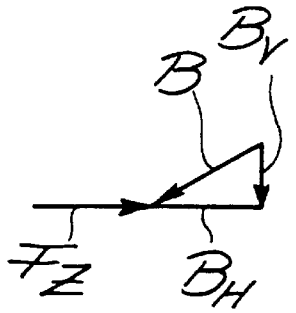
FIG.1A
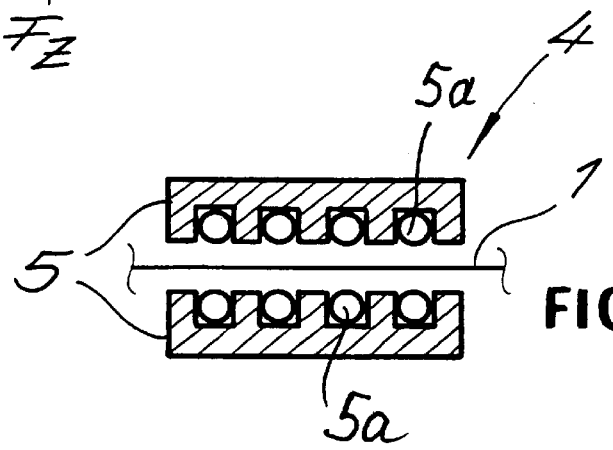
FIG.1B

METHOD OF AND APPARATUS FOR MEASURING PLANARITY OF METAL STRIP

FIELD OF THE INVENTION

The present invention relates to a method of measuring the planarity of strip, especially metal strip, continuously advanced in a processing line, for example, for the treatment of the strip, for rolling or the like, whereby the strip has a predetermined tension applied thereto and in which the planarity of the strip is measured by a measuring device responsive to unevenness of the strip and located at a distance from the strip surface.

BACKGROUND OF THE INVENTION

Planarity measurements are described, fox example, in German Patent DE-PS 28 13 719 and in German patent Document DE-OS 42 24 569. In both of these patent documents, an indirect measurement of strip planarity is carried out by measuring the strip tension forces across the width of the strip using planarity measurement rollers. The strip tension distribution can be translated into a measure of strip planarity and used in a feedback system to control the strip planarity. The strip is deflected in a measurement direction by a force generating device and the degree of deflection is measured to give the strip planarity. The measuring method is indirect and may be inaccurate because different degrees of deflection of the strip can correspond to length differences in individual strip longitudinal fibers from which the planarity must be determined.

It is possible to carry out a direct measurement of strip planarity on a table or while the strip is at standstill, i.e. when the tension has been removed from this strip. However, this technique is unacceptable for continuous processing lines since it requires an interruption in production.

Planarity measuring rollers, moreover, have a limited accuracy because the longitudinal tension in the strip can only be ascertained with a precision of about 2 to 5 Mpa which leads to inaccuracies in planarity measurement. The transverse stresses are not taken into consideration in this system although they can have an effect on planarity. Furthermore, the earlier measurement systems are sensitive to the influences of neighboring deflecting rollers, drive rollers or the process whereby the strip is wound up, since all of these influence the longitudinal tension distribution across the width of the strip.

Finally, mention should made of the fact that for direct measurement of strip planarity at standstill, the strip can suffer marking as a result of the halting of the travel of the strip. Such marking can itself be unacceptable or can lead to a reduction in quality.

OBJECTS OF THE INVENTION

It is therefore the principal object of the present invention to provide an improved process for measuring the planarity of metal strip whereby the aforedescribed drawbacks can be avoided and which can be carried out on line, i.e. without productivity loss or halting of the strip.

Another object of the invention is to provide a method of measuring strip planarity which has improved precision and reliability by comparison with earlier techniques.

It is also an object of the invention to provide an improved apparatus for measuring the planarity of a strip, especially metal strip.

SUMMARY OF THE INVENTION

These objects and others which will become apparent hereinafter are attained, in accordance with the invention, by determining the strip tension force in the measurement zone and/or directly ahead of the measurement zone and reducing that tension within the measuring zone by a predetermined amount which can be equal to the measured tension and in a targeted and controlled manner, thereby eliminating tension-dependent errors in planarity measurement to the greatest extent possible. According to this principle, the continuously travelling belt is subjected usually ahead of the measurement zone and/or in the measurement zone to a substantially oppositely directed braking force by comparison to the strip tension force, with the braking force amounting approximately to the strip tension force. In the present description, the words "tension" and "tension force" will be understood to be equivalent.

A strip processing apparatus, in accordance with the invention may include means defining a path for the strip and for continuously displacing the strip along this path and post processing means like a coating, rolling, levelling or other treatment unit or group or sequence of treatment units. The measuring zone of the invention is provided along the path and a braking unit can be provided as well to act counter to the tension. In that case, the tension may be provided by any type traction unit commonly used for strip, for example, driven pinch rollers, bridles (i.e. pairs of rolls about which the strip passes in an S pattern), the braking device being a linear motor acting upon the strip, braking rolls, a braking bridle or the like. The surface whose planarity or evenness is to be measured is usually the upper surface of the strip but can also be the lower surface or both and generally the term "planarity" as used here is intended to indicate a measurement of surface unevenness, rather than uniformity of the strip cross section.

The method of measuring planarity of metal strip in a strip processing line can, more generally, comprise the steps of:

(a) advancing the strip continuously along the line under tension;

(b) continuously measuring planarity of the strip in a measuring zone along a path of the strip as it is advanced continuously along the line; and (c) controlledly reducing the tension in the strip at least prior to departure of the strip from the zone to minimize any effect of the tension on the planarity measurement in step (b).

The apparatus can comprise:

means for advancing the strip continuously along the line under tension;

a sensor for continuously measuring planarity of the strip in a measuring zone along a path of the strip as it is advanced continuously along the line; and means connected to the sensor for controlledly reducing the tension in the strip at least prior to departure of the strip from the zone to minimize any effect of the tension on the planarity measurement in step (b).

The invention exploits the fact that by practically eliminating the tension force in the measuring zone, a quasi steady state condition is created in the measuring zone which means that the continuously travelling strip is not subjected to the loss of precision resulting from tension forces in the measurement of the surface planarity. Since the strip is practically tensionless or without significant tension in this zone, falsification in the planarity measurements which have characterized earlier systems are eliminated. This applies not only to errors which were introduced by the longitudinal tension distribution but also by transverse stresses.

Furthermore, it is not necessary to forcibly deflect this strip for the measurement of strip planarity under tension and hence errors which were introduced by such deflection under tension especially in thin strip and at edge regions of the strip no longer arise. The processing speed is practically unaffected since the continuously travelling strip is only braked over a limited region, i.e. the measurement zone and thereafter can be accelerated to its original speed and can continue to be transported along the processing line at the speed prior to braking. Standstill marking of the strip by pressing or drive rollers is likewise completely excluded.

According to a feature of the invention the continuously travelling strip can be passed partly around at least one deflecting roller ahead of, downstream of and/or in the measurement region and optionally partly around another deflecting roller downstream of the measurement zone with the roller located at the upstream side of the zone forming a tension measuring roller and allowing a determination of the tension in the strip as it enters the measuring zone. According to the invention, the tension in the measuring zone is controlled based upon this measurement and for that purpose, the tension measuring roller can output an actual value of the strip tension and this value can be used by a controller to vary the braking force. The controller may be a feedback controller or some other braking force regulator responsive to the control signal from the tension measuring device and capable of evaluating that signal.

Instead of a tension measuring roller, any other device for measuring the tension or the tension force of the strip as it enters the measurement zone can be used. Once the tension measurement is made, of course, it is no problem to generate a braking force to counteract the tension force and, moreover, a braking force which is practically equal to the tension force so that the travelling strip is practically tension free in the measurement zone. Usually the braking force is such that it is 98 to 99% of the strip tension force.

According to a feature of the invention the strip planarity is likewise carried out by a contactless measurement. Where both the braking force and the planarity measurement are carried out in a contactless manner, the surface finish of the strip can be of essentially high quality since it is not affected by the measurement process. The danger of injury to the surface finish of the strip is thus excluded.

The linear motor comprises a stator or inductor and an armature which, in the present case, is formed by the strip itself and hence functions similar to an asynchronous electric motor in which the motor action is counter to the tension force. The electric field arising in the armature is a unidirectional field which is electromagnetic ally generated, i.e. induced by comparison to the stator field. The interaction of the two fields generates the brake force. A linear motor cannot, however, be used for all materials and, for example, it cannot be used for austenitic stainless steel strip and, in that case, the brake force may have to be frictionally generated.

It has been found to be advantageous to carry out the measurement on a vertically extending stretch of the strip and over its entire strip width. The measurement zone should have a length which is equal to the maximum strip width of strip to be processed in the line.

The measured planarity can be used as an actual value signal in a planarity control system, i.e. as the actual value input for a controller which compares the actual value with a set point and thereby regulates a planarity modifying system (see DE-OS 05 42 24 569).

The planarity measuring system can be used for strip rolling, levelling and wind up processes.

BRIEF DESCRIPTION OF THE DRAWING

The above and other objects, features, and advantages will become more readily apparent from the following description, reference being made to the accompanying drawing in which:

FIG. 1 is a diagrammatically elevational view of a first embodiment of an apparatus for contactless control of the brake force;

FIG. 1A is a vector diagram illustrating an aspect of the invention;

FIG. 1B is a cross sectional view through the linear electric motor; and

SPECIFIC DESCRIPTION

Figure 2:
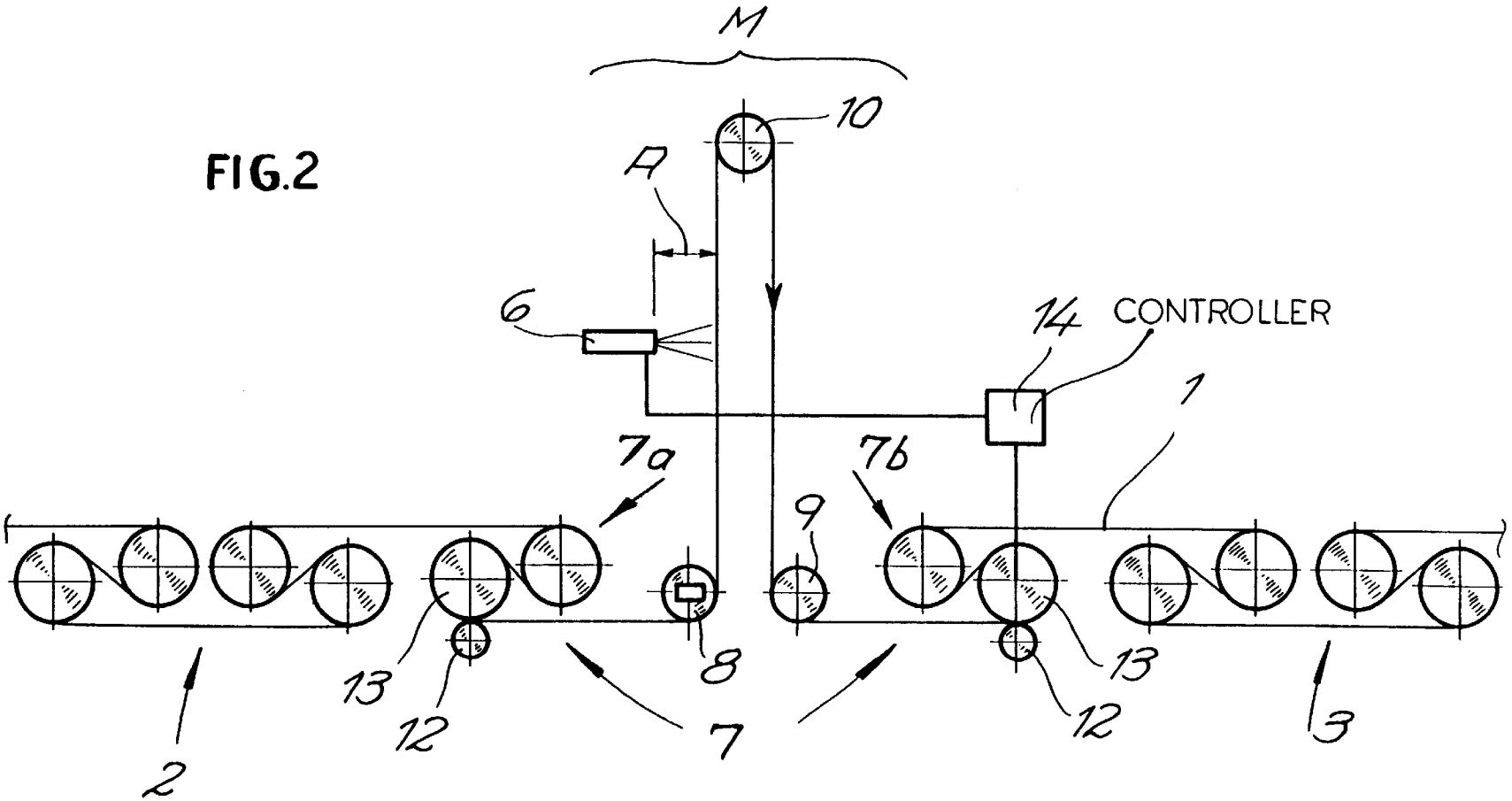
FIG. 2 is a view similar to FIG. 1 of another embodiment.

In the drawing, we have shown an apparatus for the measurement of the planarity of metal strip 1. The metal strip is assumed to be advanced with a strip tension force $F_z$ and to pass through a set of two bridles 2, 3 generating tension and a braking roller bridle set 7*a* or 7*b*. The arrangement can be of the type described in DE OS 39 12 676 or DE OS 26 25 414 (see FIG. 2).

In the embodiment of FIG. 1, the strip tension force $F_z$ is generated by the linear motor 4 or a series of such linear motors in a contactless manner. As shown in FIG. 16, these linear motors can have a stator or inductor 5, the strip 1 forming the armature. The stator 5 has stator windings 5*a*. The windings are located in slots between traverse teeth of the stator.

The strip 1 passes through the gap between the stators 5 and in the embodiment shown, for the linear motor 4, the induced field and stator field are directed in the direction of the vector $F_z$ to produce the tension force on the strip and to suspend the strip 1 floatingly between the stators. In a vertical stretch, the strip passes by a measuring device 6 within the zone M which has a length equal substantially to the maximum strip width. The measuring device 6 is at a predetermined distance A from the surface of the strip and detects an unevenness or deviations from planarity of the strip.

Within the measurement zone M and/or directly ahead of this zone, the brake tension force $F_Z$ is reduced in a targeted manner to eliminate errors in the planarity measurement which derive from the strip tension. In this case, within the zone M a brake force B is applied opposite the tension, e.g. by a braking device 7 which may also be a linear motor whose electromotor force opposes the tension force $F_Z$. In the embodiment of FIG. 2, the brake force is applied by two brake bridles or S-type roller sets 7*a*, 7*b*. In the embodiment of FIG. 1, the brake force is applied within the measurement zone M while in the embodiment of FIG. 2. The brake force is applied upstream and downstream of the measurement zone. Various components of the two can also be used.

The linear motor 7 of FIG. 1 can operate in a contactless manner and generates the braking force such that a vector $B_H$ almost equal to the tension force $F_Z$ will oppose that tension force. FIG. 1A that the braking force may be applied at an angle to the strip travel direction as long as its horizontal component B. is approximately equal and opposite to the component $F_Z$. The vertical component $B_V$ has also been shown in the vector diagram of FIG. 1A.

The continuously travelling strip should pass around at least one deflecting roller 8 upstream of or in the measurement zone M. Other deflecting rollers 9 can be provided downstream of the measuring zone or, as shown at 10, within the latter. The deflecting roller 8 located upstream of the zone here serves as a tension measuring roller and measures the tension force $F_Z$ within the zone M.

As can be seen from FIG. 1, a controller 11 can be provided which receives the measured value of the tension force from the tension measuring roller 8 and controls the braking device 7 to meet the tension force with the braking force or to generate a braking force which is say 98 to 99% of the tension force. In the embodiment of FIG. 1, the controller 11 may increase or decrease the power of the linear motor forming the brake device 7.

The measuring device 6 can include a CCD camera, a laser optic distance measuring device, an inductive or capacitor sensor or the like. The invention can make use of the MOIRÉ process to measure the planarity of the strip. In all cases the measuring device 6 is preferably provided in the vertical stretch and operates in a contactless manner. It can work by determining changes in the spacing of the strip surface from the sensor.

As can be seen from FIG. 2, the braking force can be applied by two S-type bridles 7*a*, 7*b* with associated pressing rollers 12. These bridles can be driven at different speeds so that the desired reduction in the strip tension can result. The bridles 7*a* and 7*b* can have speed controllers connected with their respective drives.

At least one of the rollers 13 of the bridle 7*b* downstream of the measurement zone M can have a variable surface area or bulge along the length thereof and can be controlled by the controller 14 in response to the measured planarity to vary that planarity by changing the shape of the roller 13. The system of FIG. 2 is especially compact since the bridle 7*b* located immediately downstream of the measurement zone M serves not only to generate the braking force B but also to vary the planarity of the strip.

We claim:

1. A method of measuring planarity of metal strip in a strip-processing line, comprising the steps of:

(a) advancing said strip continuously along said line under tension;

(b) continuously measuring planarity of said strip in a measuring zone along a path of said strip as it is advanced continuously along said line; and (c) controlledly reducing the tension in said strip at least prior to departure of said strip from said zone by controlled braking of the strip to minimize any effect of said tension on the planarity measurement in step (b).

2. The method defined in claim 1, further comprising the steps of:

measuring the tension in said strip; and braking said strip with a brake force opposite and substantially equal to said tension at least prior to departure of said strip from said zone.

3. The method defined in claim 2, further comprising deflecting said strip around at least one roller in a region of said zone for measurement of said tension in said zone.

4. The method defined in claim 3, further comprising the step of controlling said tension in said zone by deriving from said roller a measured value of said tension and controlling a brake for said strip with said measured value.

5. The method defined in claim 3 wherein said brake force is applied contactlessly to said strip in said zone.

6. The method defined in claim 1 wherein the planarity of said strip is measured contactlessly in said zone.

7. The method defined in claim 6 wherein the planarity of said strip is measured at a vertically upwardly extending stretch of said strip in said zone and over an entire width of said strip, said zone having a length approximately equal to said width of said zone.

8. The method defined in claim 1 wherein said line includes a device for controlling planarity of said strip, the continuous measurement of the planarity deriving a control signal which is applied to said device.

9. An apparatus for measuring planarity of metal strip in a strip-processing line, comprising:

means for advancing said strip continuously along said line under tension;

a sensor for continuously measuring planarity of said strip in a measuring zone along a path of said strip as it is advanced continuously along said line; and means connected to said sensor for controlledly reducing the tension in said strip at least prior to departure of said strip from said zone by controlled braking of the strip to minimize any effect of said tension on the planarity measurement in step (b).

10. The apparatus defined in claim 9 wherein said means connected to said sensor for controlledly reducing the tension in said strip is a contactless linear motor acting upon said strip.

11. The apparatus defined in claim 9 wherein said means connected to said sensor for controlledly reducing the tension in said strip is a bridle engaging said strip upstream of said zone.

12. The apparatus defined in claim 11, further comprising a pressing roller pressing said strip against one of the rolls of said bridle.

13. The apparatus defined in claim 9, further comprising a tension-measuring roller engaging said strip in a region of said zone and generating an actual value of the tension on said strip, and a controller connected to said tension-measuring roller and responsive to said actual value for controlling said braking force.

14. The apparatus defined in claim 9 wherein said zone includes a vertical stretch and has a length approximately equal to a maximum width of strip processed in said line.

* * * * *